US012767196B2

(12) United States Patent
Zhou et al.

(10) Patent No.: US 12,767,196 B2
(45) Date of Patent: Oct. 20, 2026

(54) TRAIN ADJUSTMENT METHOD FOR SAME-PLATFORM TRANSFER BETWEEN TWO LINES, DEVICE, AND MEDIUM

(71) Applicant: CASCO SIGNAL LTD., Shanghai (CN)

(72) Inventors: Gongjian Zhou, Shanghai (CN); Jiang Qian, Shanghai (CN); Jianquan Li, Shanghai (CN); Sheng Wang, Shanghai (CN); Xudong Lu, Shanghai (CN); Huaxiang Liu, Shanghai (CN); Yanan Wang, Shanghai (CN); Juan Xie, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 0 days.

(21) Appl. No.: 19/108,681

(22) PCT Filed: Nov. 16, 2023

(86) PCT No.: PCT/CN2023/131907
§ 371 (c)(1),
(2) Date: Mar. 4, 2025

(87) PCT Pub. No.: WO2024/139813
PCT Pub. Date: Jul. 4, 2024

(65) Prior Publication Data

US 2025/0381995 A1 Dec. 18, 2025

(30) Foreign Application Priority Data

Dec. 26, 2022 (CN) ..... 202211678132.0

(51) Int. Cl.
*B61L 27/04* (2006.01)
*B61L 27/16* (2022.01)

(52) U.S. Cl.
CPC ..... *B61L 27/04* (2013.01); *B61L 27/16* (2022.01)

(58) Field of Classification Search
CPC ..... B61L 27/04; B61L 27/16; B61L 27/12
See application file for complete search history.

(56) References Cited

FOREIGN PATENT DOCUMENTS

CN 103241268 A 8/2013
CN 104527733 A 4/2015
(Continued)

OTHER PUBLICATIONS

Liu et al., Paper Titled: "Intelligent Traction Control Method Based on Model Predictive Fuzzy PID Control", IEEE, Publication Date: Feb. 15, 2021 (Year: 2021).*
(Continued)

*Primary Examiner* — Grant Moubry
*Assistant Examiner* — Ruben Picon-Feliciano
(74) *Attorney, Agent, or Firm* — HSML P.C.

(57) ABSTRACT

The present invention relates to a train adjustment method for same-platform "automatic train protection", a device, and a medium. The method includes the following steps: step A: an interaction process of predicted cross-line train running information, used to achieve real-time synchronous and periodic refresh of train schedule information of two lines; step B: an automatic train association process at a transfer station, using a "magnetic attraction algorithm" to associate and match trains; and step C: an automatic train association process at a non-transfer station. Compared with the prior art, the present invention has advantages of significantly alleviating the work stress of on-site personnel, enhancing the reliability of train control at the transfer station, more comprehensively ensuring passenger transfer convenience, reducing a considerable amount of waiting time at a platform, and the like.

16 Claims, 3 Drawing Sheets

(56) References Cited

FOREIGN PATENT DOCUMENTS

| | | | | | |
|---|---|---|---|---|---|
| CN | 106476857 | A | | 3/2017 | |
| CN | 112330007 | A | | 2/2021 | |
| CN | 110222990 | B | * | 7/2021 | ..... G06Q 10/10 |
| CN | 114997545 | A | | 9/2022 | |
| CN | 115959178 | A | | 4/2023 | |
| EP | 4047533 | A | | 8/2022 | |
| JP | 2011255766 | A | | 12/2011 | |

OTHER PUBLICATIONS

Machine Translation of CN 110222990 B PDF File Name: "CN110222990B_Machine_Translation.pdf" (Year: 2021).*

International Search Report (with English translation) and Written Opinion issued in PCT/CN2023/131907, mailed Feb. 22, 2024, 12 pages provided.

Xia et al., "Study on the Train Operation Adjustment on Double-track Line Based on Ant Colony Algorithm", China Academic Journal Electronic Publishing House, Issue 27 No. 6, 2008, with English translation of the astract.

* cited by examiner

TRAIN ADJUSTMENT METHOD FOR SAME-PLATFORM TRANSFER BETWEEN TWO LINES, DEVICE, AND MEDIUM

FIELD OF TECHNOLOGY

The present invention relates to a train signal control system, and in particular to a train adjustment method for same-platform "automatic train protection", a device, and a medium.

BACKGROUND

In urban rail transit, to facilitate passenger transfer, same-platform transfer is usually used to implement large passenger flow transfer between different lines. For example, TWL and KTL lines in Hong Kong, as well as stations in Line 2 and Line 4 in Wuhan, are all designed with the same-platform transfer. Passengers complete passenger transfer rapidly by only disembarking from one train in one line, walking to an opposite platform, and boarding a train in another line. However, such seamless transfer is achieved currently by timetable-coordinated mapping, relying on a relatively long station dwell time period and manual operations by drivers. In reality, trains often experience early or delayed arrivals, which places high demands on operational staff and significantly increases a work pressure of the operational staff.

The challenge is to achieve synchronized arrival and departure of trains in two different lines at a transfer station, to alleviate the work pressure of on-site personnel, ensure convenience of passenger transfer, and reduce the amount of time spent waiting on the platform. This has become a technical problem that needs to be solved.

SUMMARY

The present invention provides a train adjustment method for same-platform "automatic train protection", a device, and a medium to overcome the defects in the prior art. Factors such as train early or delayed arrivals and re-adaptation after trains go offline are fully taken into account, so that synchronous arrival and departure control of trains at a transfer station as well as automatic adjustment of on-time performance of trains are dynamically completed, which significantly alleviates the work stress of on-site personnel, enhances the reliability of train control at a transfer station, more comprehensively ensures passenger transfer convenience, reduces a considerable amount of waiting time at a platform, and the like.

The purpose of the present invention is achieved using the following technical solutions:

According to a first aspect of the present invention, a train adjustment method for same-platform "automatic train protection" is provided. The method includes the following steps:

- step A: an interaction process of predicted cross-line train running information;
- step B: an automatic train association process at a transfer station; and
- step C: an automatic train association process at a non-transfer station.

In a preferred technical solution, step A specifically includes:

- step S1: providing a train schedule information sharing module in central servers for the two lines;

- step S2: completing caching of the train schedule information of the two lines within one hour in the sharing module for the two lines and providing a refresh interface; and
- step S3: periodically checking a communication state and cached train schedule information of the two lines in real time, to ensure that current information is valid.

In a preferred technical solution, the sharing module in step S1 is capable of obtaining a planned running time period of all trains within the current hour from existing core logic.

In a preferred technical solution, the interface in step S2 is used by the central server to automatically refresh train running data in a database after detecting an arrival time point, a departure time point, and section stop information of a train.

In a preferred technical solution, step B specifically includes:

- step S4: arranging arrival and departure of trains in the current two lines in sequence based on the transfer station;
- step S5, selecting information about arrival time points and departure time points of all trains at the transfer station, and matching arriving train numbers;
- step S6, based on a matching result, determining a time point at which trains arrive simultaneously at the transfer station, and synchronously calculating a departure time point of the trains within a same station dwell time period; and
- step S7, calculating an arrival schedule of subsequent trains within the current hour; and based on the adjustment of the transfer station, calculating train arrival and departure time points at all subsequent stations, and finally calculating arrival time points and departure time points of all trains in the two lines within the current hour.

In a preferred technical solution, in step S4, the transfer station is used as an information extraction node, the information about arrival time points and departure time points of all trains at the transfer station is selected, and evaluation is performed based on a quantity of trains in a current time period, to select a line with more stopped trains as basic fixed reference data.

In a preferred technical solution, in step S5, arriving trains are matched based on a smallest time difference between arrival and departure time of one line at a transfer platform as a basis and train arrival and departure time of the other line at the transfer platform, to implement "magnetic attraction" follow-up between the two lines.

In a preferred technical solution, a time difference for matching needs to be less than a maximum station dwell time period of a train at the transfer station.

In a preferred technical solution, the magnetic attraction process is shown as follows: a quantity of trains passing through the transfer station within the current hour is calculated, train arrival and departure time points in a line with more trains are used as a fixed reference system through comparison, and a line with fewer trains is selected for train adjustment.

In a preferred technical solution, the adjustment process specifically includes:

- selected train arrival and departure time points are compared one by one with the train arrival and departure time points in the fixed reference system; trains with a smallest time difference are selected as trains that arrive and depart simultaneously for establishing the same-platform transfer; and if a current error is greater than a maximum station dwell time period of current station stop but less than a maximum error range of a system, adjustment is made based on a default maximum station dwell time period of the system, without regard to simultaneous departure;

if the current error is not greater than the maximum station dwell time period and also within the maximum error range of the system, adjustment is made based on simultaneous departure; or if an error between arrival time points of two currently most proper trains is greater than the maximum error range of the system, simultaneous arrival cannot be achieved for the system by default, and original train arrival and departure time points remain unchanged.

In a preferred technical solution, step C specifically includes:

step S8: based on recalculated train arrival and departure information at the transfer station, ensuring that a running error of a train at another non-transfer station is minimized in a case that a time period at the transfer station remains unchanged;

step S9: making automatic adjustment based on a maximum stop time period and a minimum stop time period at a non-transfer station and a maximum train running speed and a minimum train running speed in a train section;

step S10: feeding an automatically adjusted predicted train schedule back to a central server for each line, forbidding, by the central server, any other adjustment algorithm, and controlling a train based on currently adjusted train schedule information; and step S11: after a train departs from the transfer station each time, re-triggering calculation information of the transfer station, and performing real-time refresh to ensure that an arrival time point and a departure time point of a train at the transfer station remain valid.

In a preferred technical solution, the central server timely notifies the sharing module of a change in corresponding actual train running information if any, the sharing module updates states of locally actual train arrival and departure time points and adjusts only a subsequent future train plan for existing nodes.

In a preferred technical solution, the sharing module stores basic running data of the two lines in advance, including: a maximum station dwell time period and a minimum station dwell time period, a maximum section running time period and a minimum section running time period, number information of each station platform, and a location of a transfer station.

In a preferred technical solution, in the method, one line is preferentially selected as a reference coordinate system which is kept unchanged, and a train in the other line is actively attracted to train arrival and departure time points in the first line, wherein a line selected as a fixed reference coordinate system needs to be a reference system with most trains, at a transfer station, passing through a common section of two lines, and if quantities of passing trains are equal, train arrival and departure time points of one of the two lines are selected by default as a reference system.

In a preferred technical solution, train arrival and departure time points in the other line are forcibly matched to one line within a set adjustable range by using a fixed reference rate in the method, subsequently, any error is automatically adjusted by adjusting a stop time period and an section running time period for a non-transfer platform, thereby implementing a plurality of adjustments based on actual train arrival and departure at all stations, and ultimately implementing simultaneous arrival of the two lines at the transfer platform ultimately.

In a preferred technical solution, an automatic adjustment process for a non-transfer platform in the method implements final on-time arrival of trains by adjusting a station dwell time period and an inter-station running speed of the trains;

in the method, real-time information is controlled within an allowable configurable update interval, and a maximum section running time period and a maximum station dwell time period of the train are considered valid real-time values; and in the method, a final result is fed back to a central server through a set information bit, and if the central server detects that a current result has already been adjusted, no further adjustment is made, or if the central server detects that no adjustment has been made, an automatic adjustment algorithm of the central server automatically intervenes to ensure that a train arrives on time.

According a second technical aspect of the present invention, an electronic device is provided, including a memory and a processor, where a computer program is stored in the memory, and when the processor executes the program, the above method is implemented.

According to a third aspect of the present invention, a computer-readable storage medium that stores a computer program is provided, and when the program is executed by a processor, the above method is implemented.

Compared with the conventional technologies, the present invention has the following advantages.

1. An innovation point of the present invention is that real-time synchronous and periodic refresh of train schedule information of two lines are implemented for the first time. In the prior art, because each line is calculated separately without any information sharing, it is impossible to calculate simultaneous collaboration of trains between the two lines.
2. An innovation point of the present invention is the introduction of the magnetic attraction algorithm. In the algorithm, at a transfer station, based on arrival and departure time points in one line, a train for same-platform transfer in the other line automatically associates with and matches a train in the first line based on errors of the arrival and departure time points, thereby forming an association relationship between trains in the two lines. Such magnetic attraction function cannot be completed between existing separate lines.
3. An innovation point of the present invention is that the information about the current train arrival and departure time points is considered in a case of train arrival and departure on a same platform, reducing the influence on the on-time rate for a non-coupling station generated by coupling of train running at the transfer station. Coupling at the transfer station and interval adjustment at the non-transfer station ensure on-time running of trains in the two lines. Such calculation and computer-assisted adjustment cannot be completed in existing separately controlled lines.
4. In the present invention, precise calculation and control of trains in the two lines are implemented through computer-assisted computation, which is more accurate than existing manual control relying on drivers, station staff, and control center dispatchers. According to the present invention, the work stress of related personnel is significantly reduced, and more reliable running of the trains in the two lines is ensured by using the system.

DESCRIPTION OF THE EMBODIMENTS

Technical solutions in embodiments of the present invention are clearly and completely described below with reference to accompanying drawings in the embodiments of the present invention. Apparently, the described embodiments are merely some rather than all of the embodiments of the present invention. Based on the embodiments of the present invention, all other embodiments obtained by those of ordinary skill in the art without creative effort shall fall within the protection scope of the present invention.

There are some lines with same-platform transfer in the operation of urban rail transit, in which trains are required to arrive simultaneously on a platform to facilitate transfer between two trains on the same platform. However, because a train is either early or delayed during actual running, there is a great error between arrivals and departures and a great work pressure relying solely on timetable design and manual coordination on the same platform. Therefore, a method is required for dynamically ensuring synchronized arrival and departure of trains in two different lines, thereby improving service accuracy and reliability and greatly alleviating the pressure on on-site operational personnel.

The present invention relates to an automatic adjustment method for synchronizing arrival and departure of trains on a transfer platform based on computer automatic adjustment algorithm control. Traditional automatic train running adjustment is based on a running state of a current line. In the present invention, a joint adjustment algorithm for a common section of two lines is implemented to dynamically control train arrival and departure time points of trains. In combination with a traditional train adjustment algorithm, an algorithm for optimizing same-platform transfer between trains in two lines is implemented, which improves a currently static timetable-based control approach and reduces an adjustment pressure on drivers and control center dispatchers, ensuring improvement of the quality of transfer service in the two lines.

The present invention provides a train adjustment method for same-platform "automatic train protection", a device, and a medium. The method includes the following steps.

Figure 1:
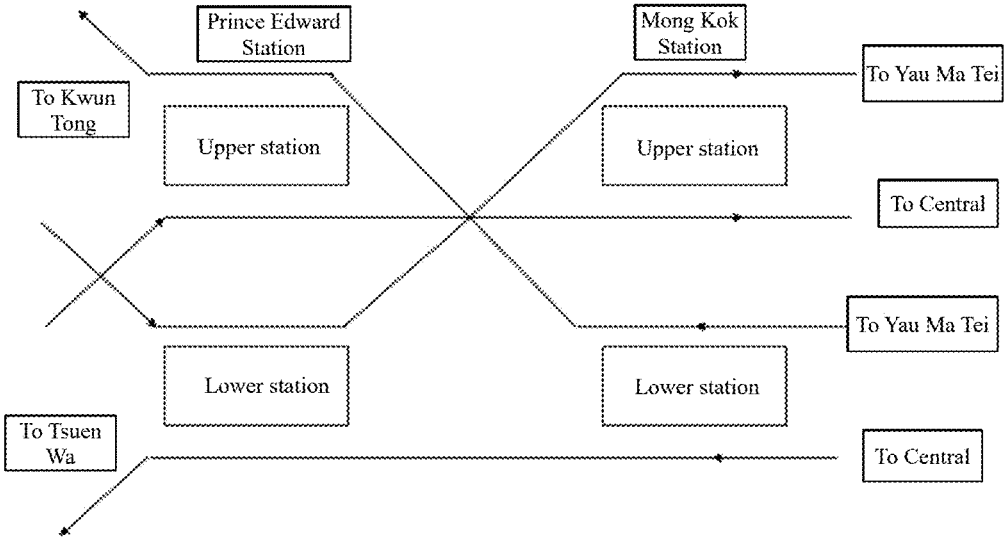
FIG. 1 is a schematic diagram of same-platform transfer at Hong Kong Metro.
Figure 2:
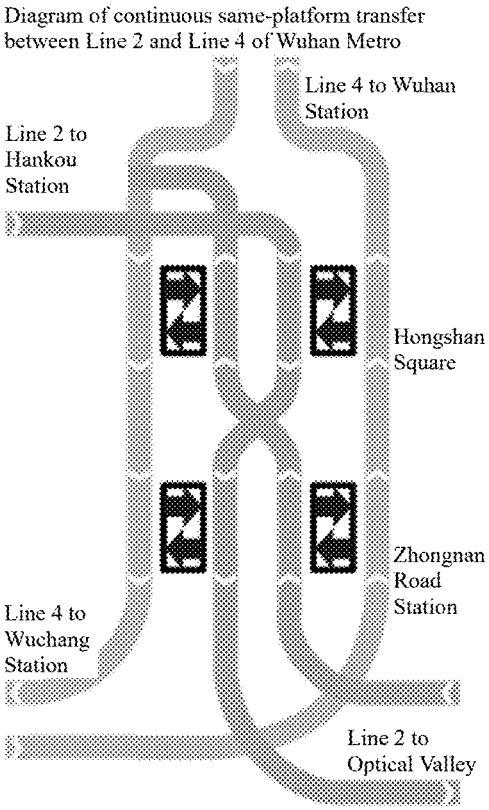
FIG. 2 is a schematic diagram of same-platform transfer between Line 2 and Line 4 of Wuhan Metro.
Figure 3:
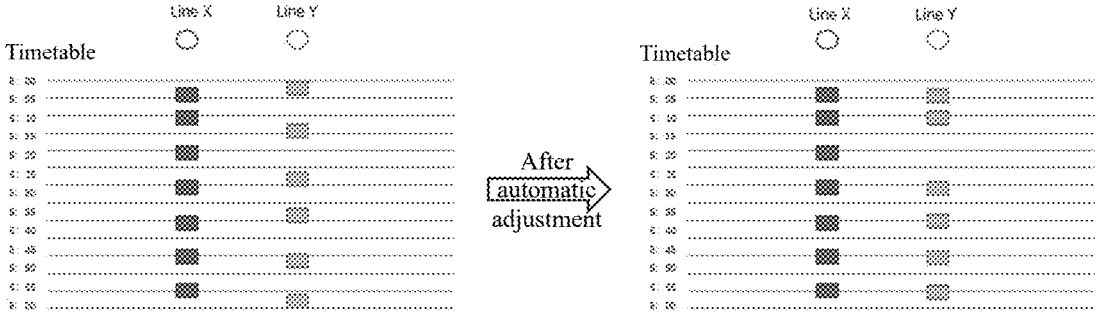
FIG. 3 is a schematic diagram of automatic adjustment of a transfer station timetable.

Step S1: This method is performed in a scenario of train control for same-platform transfer, to ensure that trains in two different lines arrive on a platform simultaneously, allowing passengers to transfer directly and preventing passenger congestion in a platform area, as shown in FIG. 1 and FIG. 2.

Step S2: In the present invention, train running within one hour is controlled based on real-time predictive train timetable data for two lines, to precisely manage train running in a current time period.

Step S3: In the present invention, first, information about a transfer station in the two lines and basic parameters for the two lines are identified through configuration, including a maximum/minimum station dwell time period and a maximum/minimum section running time period, thereby processing a train schedule for the two lines received subsequently in current three hours.

Step S4: an external control center needs to timely notify a module library in the present invention of a change in actual train running information if any, the module updates states of locally actual train arrival and departure time points, and a system does not adjust any change in existing time points, but adjusts only a future train schedule.

Figure 4:
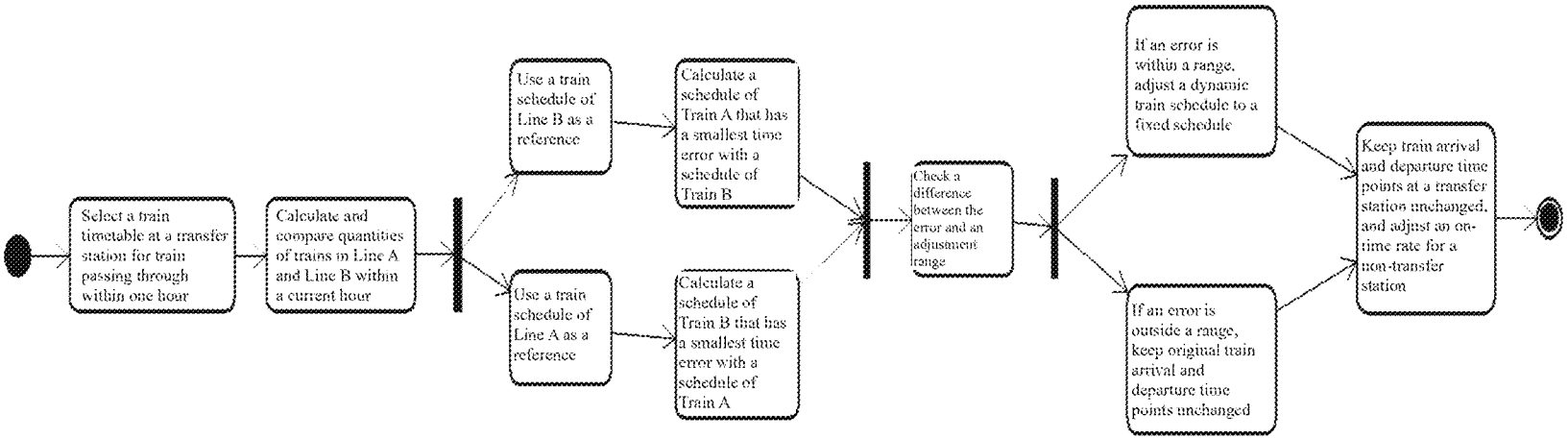
FIG. 4 is a flowchart of an automatic adjustment method for the same-platform transfer.

Step S5: After receiving train information update, the module developed in the present invention automatically starts a magnetic attraction algorithm, as shown in FIG. 4, to calculate a quantity of trains passing through a transfer station within a current hour, and train arrival and departure time points in a line with more trains are selected as a fixed reference system through comparison, with no adjustment made to the arrival and departure time points of the trains, and a line with fewer trains is selected for train adjustment.

Step S6: Selected train arrival and departure time points are compared one by one with the train arrival and departure time points in the fixed reference system. Trains with a smallest time difference are selected as trains that arrive and depart simultaneously for establishing the same-platform transfer. If a current error is greater than a maximum station dwell time period of current station stop but less than a maximum error range of the system, adjustment is made based on a default maximum station dwell time period of the system, without regard to simultaneous departure. If the current error is not greater than the maximum station dwell time period and also within the maximum error range of the system, adjustment is made based on simultaneous departure. If an error between arrival time points of two currently most proper trains is greater than the maximum error range of the system, simultaneous arrival cannot be achieved for the system by default, and original train arrival and departure time points remain unchanged.

Step S7: Based on the planned arrival and departure time point information of the trains, the train arrival and departure time points at the transfer station remain unchanged, and planned train arrival and departure time points are adjusted for trains that still do not run, to ensure on-time train running. For a train that still cannot resume on-time running after adjustment, the train remains delayed.

Step S8: After an arrival and departure timetable for all trains have been adjusted, a current module submits adjusted train arrival and departure time points to an execution unit for train control.

Step S9: Before a magnetic attraction algorithm for train coupling is performed each time, this module needs to perform validity check and real-time check on current planned information, and if any data is found to be expired, a same-platform transfer algorithm for a current timetable is immediately disabled, which is described based on a requirement for which trains in two different lines simultaneously arrive at a same platform for same-platform transfer. Basic running data of the two lines needs to be obtained in advance, including: a maximum/minimum station dwell time period, a maximum/a minimum section running time period, number information of each station platform, and a location of a transfer station. In the system, one line is preferentially selected as a reference coordinate system which is kept unchanged. A train in the other line is actively attracted to train arrival and departure time points in the first line. A line selected as a fixed reference coordinate system needs to be a reference system with most trains at a transfer station in a common section of two lines. If quantities of passing trains are equal, train arrival and departure time points of one of the two lines are selected by default as a reference system.

Train arrival and departure time points in the other line are forcibly matched to one line within a specific adjustable range by using a fixed reference rate. Subsequently, any error is automatically adjusted by adjusting a stop time period and an section running time period for a non-transfer platform. This process allows for a plurality of adjustments based on actual train arrival and departure at all stations. The two lines can simultaneously arrive at the transfer platform ultimately, and an adjusted train can ultimately arrive on time at a return platform, without affecting return running of a subsequent train.

This method requires basic information of the two lines, including timetable information of all trains passing through the transfer station and adjustable parameter information of the transfer station. An automatic adjustment algorithm for a non-transfer platform implements final on-time arrival of a train by adjusting a station dwell time period and an inter-station running speed of the train.

Considering that adjusted train arrival and departure time points in this method directly have an influence on online control, real-time information is controlled within an allowable configurable update interval. Typically, a maximum section running time period and a maximum station dwell time period of the train are considered valid real-time values. To ensure a smooth transition from the entire adjustment algorithm to a single-line automatic adjustment algorithm, a final result is fed back to the external control module through a specific information bit in this adjustment algorithm. If the external control module detects that the current result has already been adjusted, no further adjustment is made. If the external control module detects that no adjustment is made by the current algorithm, an automatic adjustment algorithm of a single-line control center intervenes automatically to ensure the train arrives on time.

Specific Implementation

First, an operation mode of the present invention is introduced, with main steps described as follows:

Step 1: the algorithm included in this method is encapsulated in a general LIB library, and a central server of existing lines needs to provide access and invocation based on LIB interface requirements.

Step 2: This method includes address configuration and communication requirements for internal communication between the two lines, a central server for the two lines on site needs to load corresponding data configuration to construct a local communication group, creating a basic environment for synchronizing train running information.

Step 3: Once an algorithm library included in this method detects a communication interruption in the local communication group and is unable to synchronize information, a corresponding algorithm is paused. The central server invokes input planned train arrival and departure time points and returns the input planned train arrival and departure time points to an original invocation algorithm. The central server uses a flag bit to indicate that a current plan is not adjusted and then controls train running based on the original single-line adjustment algorithm.

Step 4: The algorithm library included in this method automatically negotiates and fixes train information of one line as a reference system, while train schedule information of the other line serves as a magnetic attraction system. The central server needs to automatically update the algorithm library with planned train running information within one current hour based on train arrival or departure and section stop. Once receiving arrival and departure information of trains at the transfer station, the algorithm library in this method automatically performs calculation based on locally cached arrival/departure information of the two lines.

Step 5: After correctly obtaining train running information of the two lines, the algorithm library included in this method automatically starts the magnetic attraction algorithm, automatically calculates a matching relationship between the two lines, automatically calculates synchronous train arrival and departure time points for a transfer platform, and completes automatic adjustment for a non-transfer platform. The central server uses the flag bit to indicate that the current train information has been adjusted. Once obtaining the information about train arrival and departure time points, the central server directly outputs the information on site to control the trains. A local automatic adjustment algorithm no longer performs secondary adjustment calculation.

Step 6: The algorithm library in this method continuously checks the real-time validity of the current information, if locally cached information is not refreshed within a specific period, the current algorithm library is disabled by default, and the current algorithm is paused. Once the train schedule information is updated, the corresponding algorithm is re-enabled immediately.

The above describes the implementation of the method. The following provides further explanation of the proposed solution through examples related to electronic devices and storage media.

The electronic device in the present invention includes a central processing unit (CPU), which can perform various proper actions and processing based on computer program instructions stored in a read-only memory (ROM) or computer program instructions loaded from a storage unit to a random access memory (RAM). The RAM also stores various programs and data that are necessary for device operation. The CPU, ROM, and RAM are connected to each other via a bus. An input/output (I/O) interface is also connected to the bus.

Several components in the device are connected to the I/O interface, including: input units, such as a keyboard, a mouse, and the like; output units, such as various monitors, speakers, and the like; storage units, such as a disk, an optical disc, and the like; and communication units, such as a network card, a modem, a wireless communication transceiver, and the like. The communication unit allows the device to exchange information/data with other devices through computer networks and/or various telecommunication networks.

The processing unit performs the methods and processing described above, such as the method in the present invention. For example, in some embodiments, the method in the present invention may be implemented as computer software programs that are tangibly included in a machine-readable medium, such as a storage unit. In some embodiments, some or all of the computer programs may be loaded and/or installed onto the device via the ROM and/or communication unit. When the computer programs are loaded into the RAM and executed by the CPU, one or more of the steps of the method in the present invention described above can be performed. Alternatively, in other embodiments, the CPU may be configured to perform the method in the present invention in any other proper manner (for example, with the help of firmware).

Functions described above in the specification can be performed, at least in part, by one or more hardware logic components. For example, hardware logic components that can be used as examples include, unlimitedly, a field-programmable gate array (FPGA), an application-specific integrated circuit (ASIC), an application-specific standard product (ASSP), a system-on-chip (SOC), a complex programmable logic device (CPLD), and the like.

Program code for implementing the method in the present invention may be written in any combination of one or more programming languages. The program code may be provided to processors or controllers of general-purpose computers, specialized computers, or other programmable data processing devices, so that when the program code is executed by the processors or controllers, functions/operations specified in flowcharts and/or block diagrams are implemented. The program code can be executed entirely on a machine, partially on the machine, partially on the machine and partially on a remote machine as a separate software package, or entirely on the remote machine or server.

In the context of the present invention, a machine-readable medium may be a tangible medium that may contain or store programs for use by or in combination with an instruction execution system, apparatus, or device. The machine-readable medium may be either a machine-readable signal medium or machine-readable storage medium. The machine-readable medium may include, but is not limited to, an electronic, magnetic, optical, electromagnetic, infrared, or semiconductor system, apparatus, or device, or any proper combination thereof. A more specific example of the machine-readable storage medium includes an electrical connection based on one or more wires, a portable computer disk, a hard disk, a random access memory (RAM), a read-only memory (ROM), an erasable programmable read-only memory (EPROM or flash memory), an optical fiber, a portable compact disk read-only memory (CD-ROM), an optical storage device, a magnetic storage device, or any proper combination thereof.

The foregoing descriptions are merely implementations of the present invention, but are not intended to limit the protection scope of the present invention. Any equivalent variation or replacement readily figured out by a person skilled in the art within the technical scope disclosed in the present invention shall fall within the protection scope of the present invention. Therefore, the protection scope of the present application shall be subject to the protection scope of the claims.

What is claimed is:

1. A method for adjusting operations of trains for same-platform "automatic train protection", comprising the following steps:

step A: an interaction process of predicted cross-line train running information, including synchronizing in real-time and periodically refreshing train schedule information of two lines;

step B: an automatic train association process at a transfer station, using a "magnetic attraction algorithm" to associate and match trains; and step C: an automatic train association process at a non-transfer station, wherein step B comprises:

step S4: controlling arrival and departure of trains in the current two lines in sequence based on the transfer station;

step S5, selecting information about arrival time points and departure time points of all trains at the transfer station, and matching arriving train numbers;

step S6, based on a matching result, determining a time point at which trains arrive simultaneously at the transfer station, and synchronously determining a departure time point of the trains within a same station dwell time period; and step S7, determining an arrival schedule of subsequent trains within the current hour; and based on the adjustment of the transfer station, determining train arrival and departure time points at all subsequent stations, and finally determining arrival time points and departure time points of all trains in the two lines within the current hour, wherein in step S4, the transfer station is used as an information extraction node, the information about arrival time points and departure time points of all trains at the transfer station is selected, and evaluation is performed based on a quantity of trains in a current time period, to determine a line with more stopped trains as basic fixed reference data, wherein in step S5, arriving trains are matched based on a smallest time difference between arrival and departure time of one line at a transfer platform as a basis and train arrival and departure time of the other line at the transfer platform, to implement "magnetic attraction" follow-up between the two lines, wherein a time difference for matching needs to be less than a maximum station dwell time period of a train at the transfer station, wherein the magnetic attraction process is as follows: a quantity of trains passing through the transfer station within the current hour is determined, train arrival and departure time points in a line with more trains are used as a fixed reference system through comparison, and a line with fewer trains is selected for train adjustment, wherein the adjustment comprises:

selected train arrival and departure time points are compared one by one with the train arrival and departure time points in the fixed reference system; trains with a smallest time difference are selected as trains that arrive and depart simultaneously for establishing the same-platform transfer; and if a current error is greater than a maximum station dwell time period of current station stop but less than a maximum error range of a system, adjustment is made based on a default maximum station dwell time period of the system, without regard to simultaneous departure;

if the current error is not greater than the maximum station dwell time period and also within the maximum error range of the system, adjustment is made based on simultaneous departure; or if an error between arrival time points of two currently most proper trains is greater than the maximum error range of the system, simultaneous arrival cannot be achieved for the system by default, and original train arrival and departure time points remain unchanged, wherein the method further comprises controlling the operations of the trains based on the train adjustment.

2. The method for adjusting operations of trains for same-platform "automatic train protection" according to claim 1, wherein step A specifically comprises:

step S1: providing a train schedule information sharing module in central servers for the two lines;

step S2: completing caching of the train schedule information of the two lines within one hour in the sharing module for the two lines and providing a refresh interface; and step S3: periodically checking a communication state and cached train schedule information of the two lines in real time, to ensure that current information is valid.

3. The method for adjusting operations of trains for same-platform "automatic train protection" according to claim 2, wherein the sharing module in step S1 is capable of obtaining a planned running time period of all trains within the current hour from existing core logic.

4. The method for adjusting operations of trains for same-platform "automatic train protection" according to claim 2, wherein the interface in step S2 is used by the central server to automatically refresh train running data in a database after detecting an arrival time point, a departure time point, and section stop information of a train.

5. The method for adjusting operations of trains for same-platform "automatic train protection" according to claim 1, wherein step C specifically comprises:

step S8: based on recalculated train arrival and departure information at the transfer station, ensuring that a running error of a train at another non-transfer station is minimized in a case that a time period at the transfer station remains unchanged;

step S9: making automatic adjustment based on a maximum stop time period and a minimum stop time period at a non-transfer station and a maximum train running speed and a minimum train running speed in a train section;

step S10: feeding an automatically adjusted predicted train schedule back to a central server for each line, forbidding, by the central server, any other adjustment algorithm, and controlling a train based on currently adjusted train schedule information; and step S11: after a train departs from the transfer station each time, re-triggering calculation information of the transfer station, and performing real-time refresh to ensure that an arrival time point and a departure time point of a train at the transfer station remain valid.

6. The method for adjusting operations of trains for same-platform "automatic train protection" according to claim 2, wherein the central server timely notifies the sharing module of a change in corresponding actual train running information if any, the sharing module updates states of locally actual train arrival and departure time points and adjusts only a subsequent future train schedule for existing nodes.

7. The method for adjusting operations of trains for same-platform "automatic train protection" according to claim 2, wherein the sharing module stores basic running data of the two lines in advance, comprising: a maximum station dwell time period and a minimum station dwell time period, a maximum section running time period and a minimum section running time period, number information of each station platform, and a location of a transfer station.

8. The method for adjusting operations of trains for same-platform "automatic train protection" according to claim 1, wherein in the method, one line is preferentially selected as a reference coordinate system which is kept unchanged, and a train in the other line is actively attracted to train arrival and departure time points in the first line, where a line selected as a fixed reference coordinate system needs to be a reference system with most trains at a transfer station in a common section of two lines, and if quantities of passing trains are equal, train arrival and departure time points of one of the two lines are selected by default as a reference system.

9. The method for adjusting operations of trains for same-platform "automatic train protection" according to claim 1, wherein train arrival and departure time points in the other line are forcibly matched to one line within a set adjustable range by using a fixed reference rate in the method, subsequently, any error is automatically adjusted by adjusting a stop time period and an section running time period for a non-transfer platform, thereby implementing a plurality of adjustments based on actual train arrival and departure at all stations, and ultimately implementing simultaneous arrival of the two lines at the transfer platform ultimately.

10. The method for adjusting operations of trains for same-platform "automatic train protection" according to claim 9, wherein an automatic adjustment process for a non-transfer platform in the method implements final on-time arrival of trains by adjusting a station dwell time period and an inter-station running speed of the trains;

in the method, real-time information is controlled within an allowable configurable update interval, and a maximum section running time period and a maximum station dwell time period of the train are considered valid real-time values; and in the method, a final result is fed back to a central server through a set information bit, and if the central server detects that a current result has already been adjusted, no further adjustment is made, or if the central server detects that no adjustment has been made, an automatic adjustment algorithm of the central server automatically intervenes to ensure that a train arrives on time.

11. An electronic device, comprising a memory and a processor, wherein a computer program is stored in the memory, and when the processor executes the program, the method according to claim 1 is implemented.

12. A non-transitory computer-readable storage medium, storing a computer program, wherein when the program is executed by a processor, the method according to claim 1 is implemented.

13. The method for adjusting operations of trains for same-platform "automatic train protection" according to claim 1, further comprising:

refreshing train running data in a database after detecting an arrival time, a departure time, and section stop of a train, and after a train departs from the transfer station each time, performing real-time refreshing of train running data.

14. The method for adjusting operations of trains for same-platform "automatic train protection" according to claim 1, further comprising:

adjusting train schedule based on stop time at a non-transfer station and train running speed in a train section, and feeding adjusted and predicted train schedule to a central server for each line, forbidding, by the central server, any other adjustment algorithm, and controlling a train based on currently adjusted train schedule.

15. The method for adjusting operations of trains for same-platform "automatic train protection" according to claim 1, further comprising:

controlling trains for same-platform transfer to ensure that trains in two different lines arrive on a platform simultaneously, allowing passengers to transfer directly and preventing passenger congestion in a platform area;

controlling train running within one hour based on real-time predictive train timetable data for the two lines, to manage train running in a current time period;

configuring parameters for the two lines, including a station dwell time and a section running time, and processing a train schedule for the two lines received subsequently in current three hours;

after adjusting an arrival and departure timetable for all trains, submitting adjusted train arrival and departure time for train control; and before performing the magnetic attraction algorithm for train coupling each time, performing validity check and real-time check.

16. The method for adjusting operations of trains for same-platform "automatic train protection" according to claim 1, further comprising:

encapsulating the magnetic attraction algorithm included in a library, and providing access and invocation by a central server of existing lines;

configuring address for internal communication between the two lines, and constructing a local communication group by the central server; and pausing a corresponding algorithm when a communication interruption in the local communication group occurs, flagging to indicate that a current plan is not adjusted, and controlling train running based on an original single-line adjustment algorithm.

* * * * *